United States Patent [19]

Thomas

[11] 4,106,678

[45] Aug. 15, 1978

[54] GOLF BALL AND TEE CADDY

[75] Inventor: Thomas Thomas, Hollywood, Fla.

[73] Assignee: Tatco Inc., Hollywood, Fla.

[21] Appl. No.: 829,535

[22] Filed: Aug. 31, 1977

[51] Int. Cl.[2] ..... B65D 71/00

[52] U.S. Cl. ..... 224/5 D; 206/315 B; 221/309

[58] Field of Search ..... 224/5 D, 5 C, 45 L, 224/29 B; 206/315 B; 220/93; 273/74; 221/279, 309, 226; 211/14

[56] References Cited

U.S. PATENT DOCUMENTS

| | | | |
|---|---|---|---|
| 2,665,830 | 1/1954 | Fowler | 224/5 D |
| 2,768,775 | 10/1956 | Houser | 224/5 D |
| 3,206,067 | 9/1965 | Smith, Jr. et al. | 206/315 B |
| 3,497,676 | 2/1970 | Gravatt | 224/5 D |
| 4,042,156 | 8/1977 | Knight | 224/5 D |

*Primary Examiner*—Trygve M. Blix
*Assistant Examiner*—Kenneth Noland
*Attorney, Agent, or Firm*—Depaoli & O'Brien

[57] ABSTRACT

A golf ball holder for removably retaining a plurality of golf balls is provided. The holder is open ended and includes a vertically elongated hollow body member forming a pocket for the balls and a lower portion provided with transversely spaced arcuate side walls and diametrically opposed openings through which a ball may be drawn downwardly for removal. The walls of the holder are adapted to receive the shank portions of golf tees and a clip member is provided whereby the holder may be attached to the clothing worn by a golfer.

2 Claims, 6 Drawing Figures

GOLF BALL AND TEE CADDY

SUMMARY OF THE INVENTION

The invention relates to improvements in holders for removably retaining golf balls. More particularly the invention relates to an open ended holder for golf balls of simplified construction which is ornamental in appearance, inexpensive to manufacture, and very durable and efficient in use.

BACKGROUND OF INVENTION AND PRIOR ART

In playing the game of golf various golf ball holders have been proposed whereby a golfer could avoid the inconvenience of delay in locating a particular ball in the zippered pockets commonly used with golf bags. Heretofore the balls had to be removed one or two at a time until the desired ball is found, following which the balls must be then replaced in the pocket and the zipper closed. This is time consuming and frequently leads to disconcertment by other members of a foursome who are awaiting their turn to play. More importantly, if a ball is lost in the woods the player usually returns to the location of the golf bag for replacement since it may not be convenient to drive a golf cart or carry a golf bag to all parts of the golf course. Although golf balls may be carried on the golfers person in the pockets of wearing apparel, if such is provided, this has been found inconvenient since bulges are produced which may hamper the free and unrestricted movement of the body during the golf swing.

To eliminate the foregoing and provide the golfer with spare golf balls, containers adapted to be secured to the player's person have been proposed in U.S. Pat. Nos. 1,911,256, 2,548,330 and 2,768,775. Ball carriers of these types, however, were generally found lacking in several respects since they were either complicated in construction, could not be mass produced or were not considered ornamental in appearance. By means of the present invention there is provided a golf ball carrier which is simple and inexpensive and capable of performing its intended function in a highly efficient manner.

DETAILED DESCRIPTION

Figure 1:
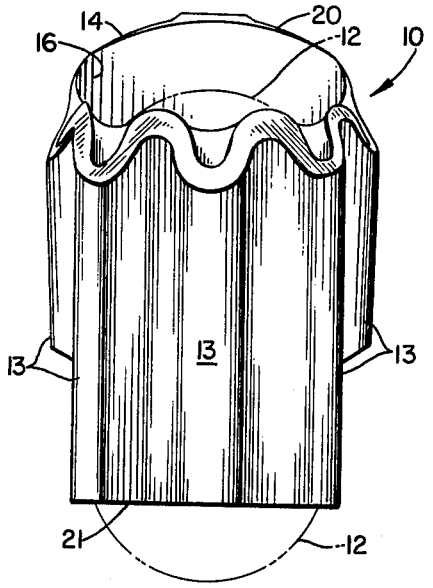
FIG. 1 is a front view of the golf ball holder of this invention.

Referring now to the drawing, one embodiment of the invention is shown in FIG. 1 wherein 10 generally designates the improved golf ball holder. The holder comprises an elongated hollow body member 14 adapted to contain a plurality of golf balls, the holder illustrated in the drawing being provided with two balls 12 for the purposes of illustration. The internal housing 16 of body 14 is essentially cylindrical throughout its vertical length and is open at both the upper and lower ends 20 and 21, respectively. The inside diameter of the housing is equivalent to or slightly larger than the diameter of a golf ball and is such that a golf ball may be slideably received therein.

Figure 2:
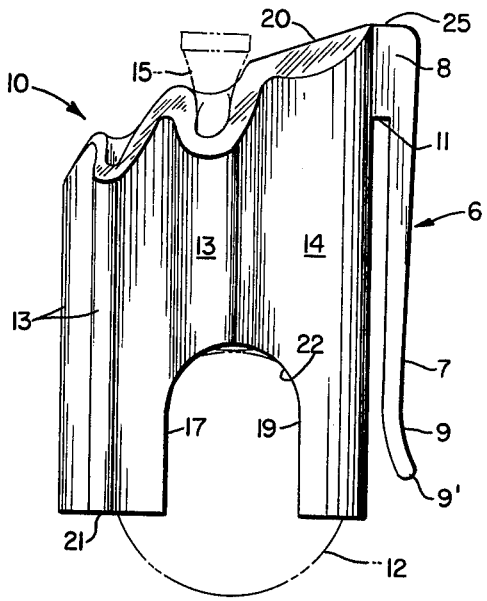
FIGS. 2 and 3 are side and back views, respectively, of the ball holder.
Figure 6:
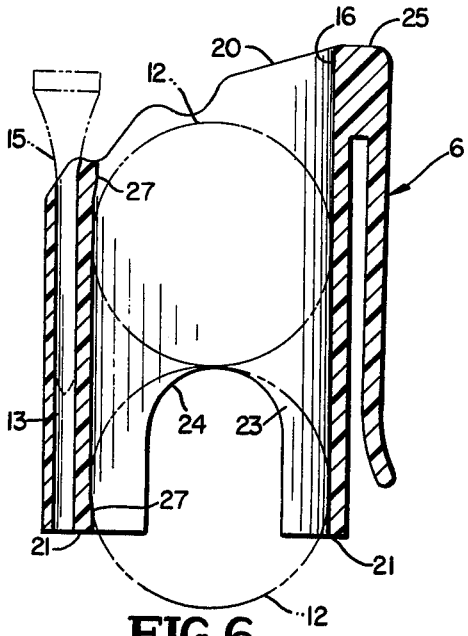
FIG. 6 is a cross-sectional view taken along line 6—6 of FIG. 4.

The body member 14 at lower end 21 of housing 16 is provided with arcuate cut our portions defining a pair of transversely spaced arcuate side walls 17 and 19 and a pair of diametrically opposed openings 22 and 24 in FIGS. 2 and 6. The side walls 17 and 19 are leg-defining walls which engage and retain a golf ball and permit a substantial portion of more than one-half the golf ball to depend below the inner curved portion 23 of the side walls.

Figure 4:
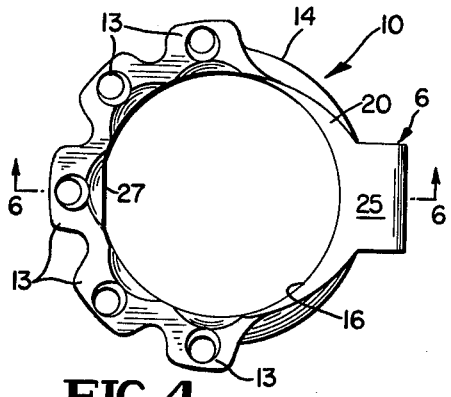
FIGS. 4 and 5 are top and bottom views, respectively, of the ball holder.

As shown in FIG. 4, to removably retain golf balls in the holder the lower and upper ends of the internal housing 16, is preferably provided with detent means 27, such as a bevel, dimples or other equivalent structure, e.g., a flatened portion of the housing, which lessens the internal diameter slightly less than the diameter of the golf ball. In this manner a ball is prevented from falling out of either end of the holder.

Figure 5:
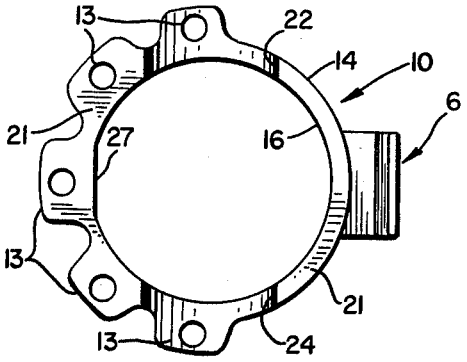

As indicated in FIGS. 4 and 5, the golf ball holder 10 includes cylindrical tubes 13 vertically arranged on the front and sides of the holder which are adapted to receive the shank portions of golf tees 15 for supporting the same in a position ready for use. The holder at the upper end 20 is cut or curved upwardly at an angle of at least about 30° from front to rear so that the tees in the supported position will not project upwardly above the top of the holder 25 and interfere with vertical insertion of the golf balls from the top.

Figure 3:
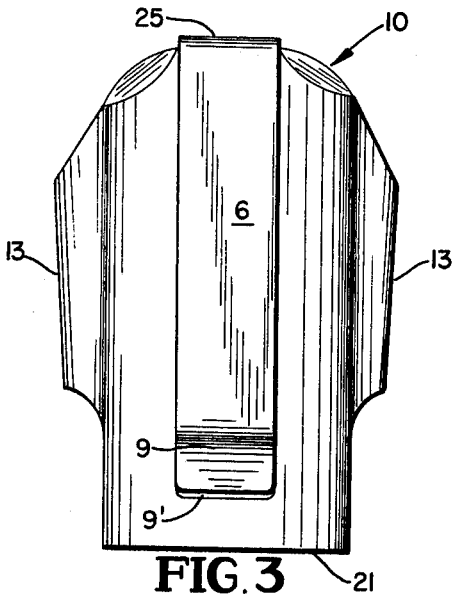

The golf ball holder 10 is provided with retaining means for attachment to the pants, skirt, belt, an edge of a pocket, or to other equipment usually encountered in playing golf such as golf bags and golf carts. In the embodiment shown in FIGS. 3 and 6 the rear of the holder is provided with a resilient clip 6 which consists of a spring tongue 7, an upper end portion 8 formed integral with the wall of the cylindrical housing, and a lower free extremity 9 curved outwardly and having a rounded end 9' to prevent injury and to facilitate the slipping of the holder in place.

The holder is preferably constructed of a suitable plastic material since it may be moulded and thus constructed inexpensively. The body member 10 and cylindrical tubes 13 may be moulded as one integral member and the clip 6 formed as another. The clip is then attached to the rear of the holder as indicated at 11 by clip, slot or other suitable means; e.g., applying a suitable solvent or cement and pressing the two parts together. After adhesion is effected the holder and clip become a single integral unitary member.

Although the holder has been illustrated holding two balls, it is apparent that a plurality of balls may be held by increasing the length of body member 14. In the preferred embodiment the holder will removably retain two balls since the size is such that the holder may be worn on the front or rear of the golfers belt or clothing and will not interfere with the golfers stroke.

The holder of the invention simplifies the means of ready access to golf balls and thus avoids the time-consuming operation of "fishing around" for a particular ball in the pocket of wearing apparel or a golf bag. In using the holder two balls are forced into position vertically from above the opening at end 20. When it is desired to remove a golf ball from the holder the lowermost ball is drawn downwardly across the detent means by force applied with the fingers through openings 22 and 24. After the lowermost ball has been withdrawn the remaining ball may also be removed or left unsupported to fall within the lower portion 21 of the holder where it is retained in its normal position.

What is claimed is:

1. An integrally molded golf ball holder comprising a vertically disposed elongated hollow body member being open at both ends thereof and having an internal diameter such that a golf ball is slideably received therein, arcuate cut out portions defining a pair of transversely spaced arcuate side walls and a pair of diametrically opposed openings disposed at the lower end of said body, said side walls being leg-defining walls which engage and retain a golf ball; holding means comprising cylindrical tubes molded integrally with said holder adapted to receive the shank of a golf tee vertically arranged on the front and sides of said body, means integral within said body for removably retaining a golf ball disposed therein whereby a ball is removed from the holder by downward movement across said means by force applied with the fingers through said diametrically opposed openings, and retaining means provided at the rear of said holder whereby the holder can be attached to pants, shirt or wearing apparel of a golf player.

2. The holder of claim 1 wherein the retaining means consists of a spring tongue having an upper end portion formed integral with the wall of said holder and a lower free extremity which curves outwardly and has a rounded end.

* * * * *